United States Patent [19]

DeLuca

[11] 4,432,261

[45] Feb. 21, 1984

[54] SEVERING WEB PLIES IN MULTIPLE ROLL MATERIAL DISPENSERS

[75] Inventor: Raymond F. DeLuca, Stamford, Conn.

[73] Assignee: Georgia-Pacific Corporation, Atlanta, Ga.

[21] Appl. No.: 333,938

[22] Filed: Dec. 23, 1981

[51] Int. Cl.[3] ..... B65H 19/06; A47K 10/36

[52] U.S. Cl. ..... 83/37; 83/334; 83/337; 83/649; 83/650

[58] Field of Search ..... 83/37, 38, 334, 335, 83/337, 338, 649, 650; 242/55.3, 55.53, 55.2

[56] References Cited

U.S. PATENT DOCUMENTS

| | | | |
|---|---|---|---|
| 4,137,805 | 2/1979 | DeLuca et al. | 83/345 |
| 4,142,431 | 3/1979 | Jepersen | 83/335 |
| 4,176,569 | 12/1979 | DeLuca | 83/337 |
| 4,188,844 | 2/1980 | DeLuca | 83/337 |
| 4,203,562 | 5/1980 | DeLuca | 242/55.3 |
| 4,206,858 | 6/1980 | DeLuca | 225/96 |
| 4,236,679 | 12/1980 | Jepersen | 242/55.53 |

*Primary Examiner*—James M. Meister

*Attorney, Agent, or Firm*—Schuyler, Banner, Birch, McKie & Beckett

[57] ABSTRACT

A dispenser for rolled flexible sheet material, wherein several plies of material fed from multiple source rolls are jointly cut while passing over a feed roller associated with a cutter, has a retarding force applied to the exterior of one source roll at a point remote from the point where such roll rests on the feed roller of the dispenser such that the interengagement between the web plies is enhanced to enable their being jointly cut by the cutter without undue slippage between the web plies.

13 Claims, 2 Drawing Figures

SEVERING WEB PLIES IN MULTIPLE ROLL MATERIAL DISPENSERS

BACKGROUND OF THE INVENTION

The invention relates to dispensing rolled flexible sheet material such as paper towels, toilet tissue and like rolls wherein each roll has a hollow central core and is mounted on support means provided within the dispenser. More particularly, the invention herein is concerned with dispensers capable of handling multiple source rolls of sheet material wherein occasion will arise for several plies of material to be jointly cut or severed in dispensing cut web sections successively from the dispenser.

Where dispensers of paper toweling in roll form are used, the dispenser is generally mounted on a wall in a location where towel availability is desired. Large numbers of such dispensers are employed in installations such factories, office buildings, institutions, etc. Substantial time and expense can be required by personnel servicing large numbers of dispensers in replenishing the exhausted wound rolls in such dispensers. This gives rise to the increasing importance of providing reliably operable multiple roll material dispensers where, upon exhaustion of material from a roll located within the dispenser at an initial or dispensing position, the web end from a reserve roll within the dispenser will effectively be picked up and fed into the dispensing mechanism to be supplied to the intending towel user. These dispensing mechanisms frequently include a perforating or severing mechanism by means of which the web material coming from the roll can be perforated or severed into individual sheets that are then fed out of the dispenser.

Also, in multiple roll dispensers for sheet material it has been known in the prior art to utilize a limited remaining portion of web material on a nearly depleted or exhausted initial roll as a convenient guide to lead the web end from a full reserve roll into the dispensing mechanism. This easily and effectively assures that the web end from the reserve roll passes into the dispensing mechanism and thence out of the dispenser to the intending user. Where this technique is employed, several plies of material will be fed from the dispenser for a limited number of cut sheet dispensing cycles, one ply coming from the nearly exhausted or depleted roll of material and the other ply coming from the fresh full reserve roll that has remained unused it the dispenser housing while the web material from the initial roll was being dispensed.

Examples of rolled flexible sheet material dispensers capable of handling multiple rolls and wherein several plies of material are fed from multiple source rolls during a limited period when a nearly exhausted or depleted roll is being replaced by start up of material taken from a full fresh reserve roll may be found in DeLuca et al U.S. Pat. No. 4,137,805 issued Feb. 6, 1979 and Jespersen U.S. Pat. No. 4,236,679 issued Dec. 2, 1980. In the multiple roll material dispenser concepts of each of these patents the changeover from dispensing web material from the nearly exhausted first roll to taking web material from the reserve roll that had been retained in the dispenser involves feeding several plies from the multiple source rolls through the dispensing mechanism out of the dispenser to the intending user. In each, the primary source roll from which the continuing web material will be supplied into the dispensing mechanism is supported to rest on a feed roller which is part of the dispensing mechanism.

A further characteristic of the type dispenser with which this invention is concerned and which is exemplified by the two above-identified patents, is that the other source from which web material has been dispensed to substantially exhaust the other source roll is separately rotatably supported during the limited internal period until the web material is fully exhausted from this other roll. In its fully exhausted or depleted state, the core of the other source roll remains in the dispenser in a discard position awaiting the service attendant's attention in reloading the dispenser with a fresh full source roll. Of course such reloading in the multiple roll material dispensers contemplated for this invention need not be undertaken until the multiple source rolls within the dispenser are totally depleted or exhausted of web material, leaving only the cores of the source rolls in the dispenser.

In the above-described type of dispensers for cut-web dispensing, it may be necessary, at least for a limited number of dispensing cycles to cut and dispense two plies of web material such as toweling. These few dispensing cycles, normally only about 10 to 14 cycles in dispensing cut individual sheets, occurs at the point whereat transfer occurs between dispensing the web material from the initial source roll that has become nearly depleted to pick up and subsequent dispensing from the reserve roll. During this transfer interval, the main source roll which is to take over supply of web material to the dispensing mechanism rests upon the feed roller with the other source roll, now nearly depleted or exhausted, supported off of or out of engagement with the feed roller while still having the web remaining on this other roll core passing over the same feed roller.

In the above-described circumstances where it is necessary to sever two layered plies of web material from two or more separate source rolls, a problem has been encountered by reason of the tendency of the two web plies to slip relative to one another when the cutting means which carries out the cut-web dispensing action is pushed through these layered plies of web material. This slippage problem may occur whether the cutting means is carried internally of the feed roller such as is characteristic in the dispensing mechanism of DeLuca U.S. Pat. No. 4,188,844 issued Feb. 19, 1980 or where the cutting means is pushed through the layered plies of web material from the exterior of the feed roller.

The problem of relative slippage between several plies of material which are being fed to a dispenser cutting mechanism from multiple source rolls must be dealt with to ensure effective cut-web dispensing of individual sheets from the multiple roll dispenser. Considering the conditions for a dispenser having a cutter mechanism in the form of a cutter-containing feed roller as disclosed in U.S. Pat. No. 4,188,844, the web of material coming from the nearly exhausted or depleted source roll which is rotatably supported off to the side of the feed roller, still passes over this feed roller. For optimum cutting, the feed roller is surfaced with a high friction material to keep this web from slipping relative to the feed roller not only to effectively drive the roller when the web is pulled out of the dispenser by the intending user, but also to prevent slippage of the web relative to the feed roller when the cutting knife is moved outwardly from the feed roller interior in performing the cutting action.

Preferably the cutting knife is provided with a serrated edge and when the points of the cutting knife first penetrate the web coming from the nearly exhausted or depleted source roll they are effective in penetrating and cutting this web but where a second web coming from the main source roll which is resting on the feed roller is present, the cutting knife tends to move this second web outwardly from the web which is in contact with the feed roller. At this stage, the knife does not fully cut this second web unless some means is provided to prevent slippage between the two webs that are being jointly dispensed in passing over the feed roller during the transfer interval that exhausts web material from the initial roll and picks up web material from the new source roll that was held in reserve.

The slippage between these several plies of web material comes about by reason of the difference in the coefficient of friction between the web resting on the high friction surface of the feed roller versus the coefficient of friction between the second web from the new source roll and which is only in surface contact with the web coming from the nearly exhausted source roll. Generally, it is found that the coefficient of friction between the several web plies is about two-thirds the coefficient of friction between the web and the high friction surface of the feed roller with which it engages.

SUMMARY OF THE INVENTION

The multiple roll material dispenser of the instant invention seeks to solve the above-described problems that are encountered in cut-web dispensing where several plies of material fed from multiple source rolls are to be jointly severed. While the invention has been particularly developed and is essentially described herein with reference to cut dispensing of two plies of web coming from two source rolls, the invention can be applied to cut-web dispensing from more than two full source rolls.

Summarizing the method invention concepts, a dispenser where several plies of material are feed from multiple source rolls to be jointly severed in carrying out a cut-web dispensing method contemplates resting one source roll on a dispensing feed roller, jointly passing the web plies over this feed roller from the source rolls, applying a retarding force to the exterior of the one source roll at a point remote from the point where it rests on the feed roller, and jointly cutting the web plies as they pass over the feed roller.

Embodying the invention in a dispenser apparatus for rolls of flexible sheet material, the invention contemplates utilizing a chassis of generally conventional configuration which is adapted to be attached to a wall location to dispense cut web individual sheets to the intending users from multiple source rolls rotatably supported by the chassis. The chassis has a feed roller mounted to rotate near the lower end thereof with a cutter associated with the feed roller and operable to cooperate with the feed roller to cut material passing over such feed roller, means carried by the chassis for rotatably supporting multiple source rolls for the web from each roll to pass over the feed roller with one of these source rolls supported to rest on the feed roller, and retarding force applying means mounted on the chassis to apply force to the exterior of the one source at a point remote from the point wherein such one source roll rests on the feed roller.

With the foregoing in mind, it is a principle object of the present invention to provide a flexible sheet material dispenser and cut-web dispensing method have improved web cutting where several plies of web material from multiple source rolls must be jointly severed.

An important object of the invention is to provide a dispenser and cut-web dispensing method as contemplated in the above object wherein a retarding force is applied to the exterior of the particular source roll which is resting on a dispensing feed roller so as to enhance the interengagement between the several web plies to enable their being jointly cut by the cutter mechanism without undue slippage between the web piles.

These and other objects of the invention will become apparent upon consideration of the detailed description of a preferred embodiment of the invention given in connection with the following described drawings which form a part of this application.

DESCRIPTION OF A PREFERRED EMBODIMENT OF THE INVENTION

Figure 1:
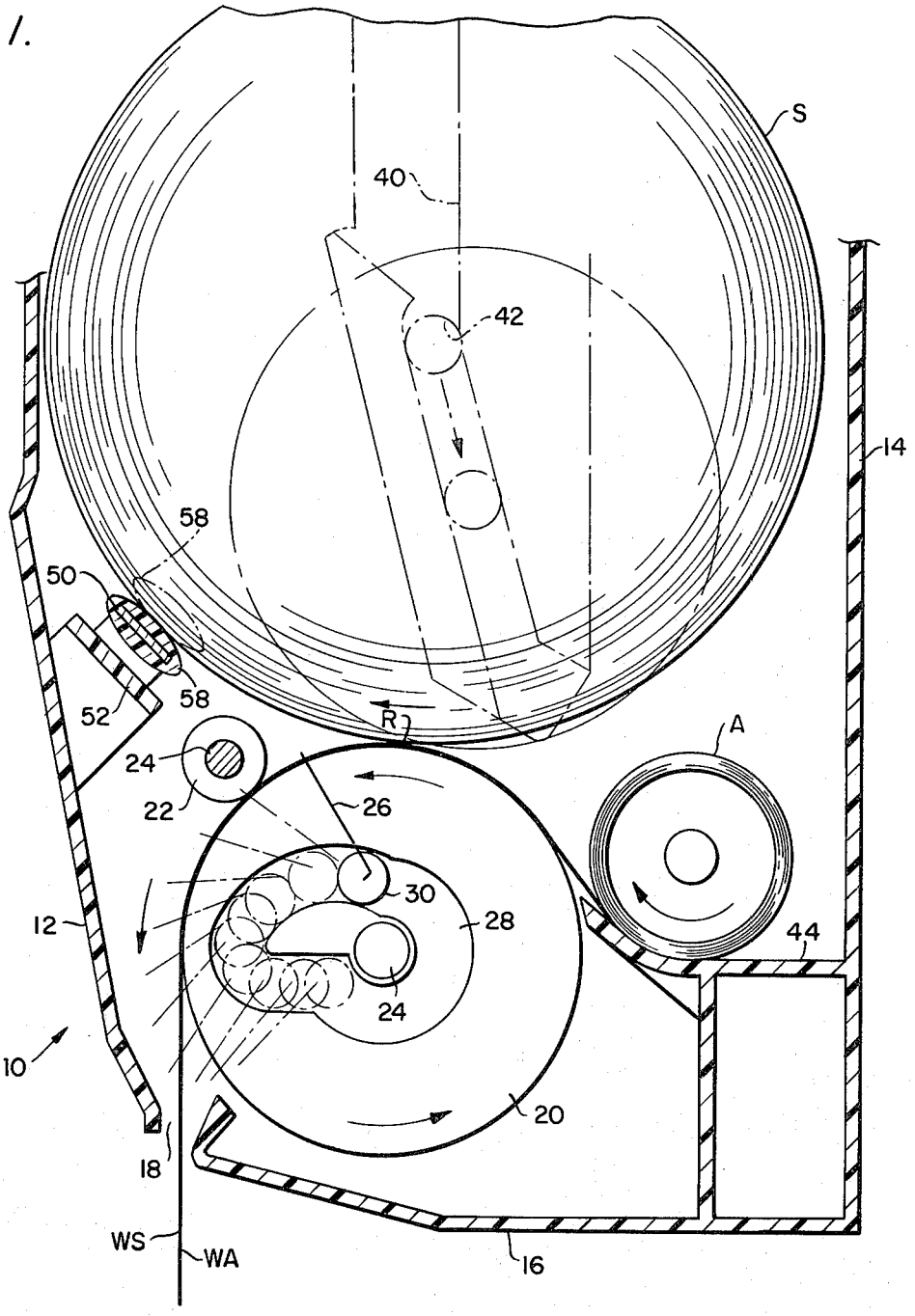
FIG. 1 is a sectional view through portions of the front, backwall and bottom of the dispenser chassis showing positions of multiple source rolls of flexible sheet material relative to a feed roller, cam activated cutting knife and pressure roller associated with retarding force applying means mounted on the chassis front.
Figure 2:
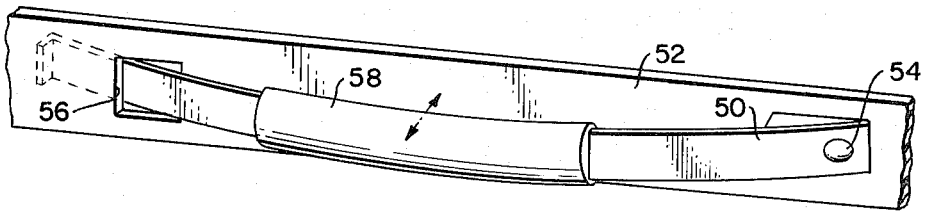
FIG. 2 is an enlarged partial perspective view showing the mounting of the flexible spring band member providing the force applying means for one source roll in the dispenser.

FIG. 1 on the drawing illustrates only the key portions of a multiple roll material dispenser which are relevant to the invention herein. It is to be understood that the concepts of the invention hereinafter disclosed in detail, will be embodied in a dispenser for rolled flexible sheet material having overall structural features such as disclosed in DeLuca et al U.S. Pat. No. 4,137,805 issued Feb. 6, 1979, DeLuca et al U.S. Pat. No. 4,203,562 issued May 20, 1980 or DeLuca U.S. patent application Ser. No. 58,867, filed July 19, 1979. These two patents and patent application disclose dispensers which are generally characterized by their capability of handling multiple source rolls of flexible sheet material with one source roll being loaded into a reserve position within the dispenser and the web end thereof picked up only upon near exhaustion or depletion of the web material from the initial source roll. The web material from this one source roll held in reserve is then fed jointly with the remaining web material coming from the other source roll for the two webs of material to be fed across a feed roller in a cutter mechanism to be jointly cut in supplying individual cut sheets from the webs until the material on the other source roll is entirely depleted. It is to be understood that one or another of these two patents and patent applications may be referred to for a full understanding of the complete multiple roll material dispenser contemplated for the instant invention to be incorporated in.

Referring specifically to FIG. 1, the multiple roll material dispenser has a chassis 10, shown as made up of a front 12, backwall 14 and bottom 16. The utilization of the type dispenser contemplated, the backwall 14 of dispenser chassis 10 will be appropriately constructed to be adapted for attachment to a wall at the location for flexible sheet material use by intended users. It will be readily understood that the particular configuration of chassis 10 is subject to a wide variety of constructions and the particular configuration shown on FIG. 1 for the portions 12, 14 and 16 making up chassis 10, is solely for purposes of illustrating the concepts of the invention.

The chassis 10 is also conventionally provided with an elongated opening 18 which will extend across a major portion of the width of the dispenser chassis, this being shown on FIG. 1 as located at the forward end of bottom 16 of chassis 10 with the opening providing means for leading the dispensed web material, cut into individual sheets, to be accessable to the intending user.

The dispenser chassis 10 has a feed roller 20 rotatably mounted thereon near the lower end of the chassis. In the embodiment illustrated, the feed roller 20 has the web material coming from two source rolls rotatably mounted within the dispenser passing over the feed roller and then down and out through elongated opening 18 to be guided to the intending users. A pinch roller 22 mounted on shaft 24 is spring biased into engagement with the exterior of feed roller 20 with the web plies coming from the source rolls in the dispenser passing between the pinch roller and the feed roller.

The feed roller 20 is rotatably mounted on the dispenser chassis 10 for one source roll which is in the primary dispensing position within the dispenser to engage and be driven by the feed roller in dispensing cut-web material from this one source roll resting on the feed roller 20.

A feed roller 20 as illustrated in FIG. 1 is contemplated to be of the type which contains a movably mounted cutter and operating means is provided to project and retract this cutter relative to the periphery of feed roller 20 to effect cutting of web material as the feed roller rotates during material dispensing. An appropriate cutter-containing feed roller construction with appropriate operating means for the movable cutter is disclosed in DeLuca U.S. Pat. No. 4,188,844 issued Feb. 19, 1980 and reference to such patent may be made for a fuller understanding of the operational characteristics of a cutter-containing feed roller as is contemplated by the illustration of feed roller 20 on FIG. 1. Even more specific details for a cutter-containing feed roller, its operational characteristics and related components may be found in application Ser. No. 58,867, filed July 19, 1979 which was a continuation of Ser. No. 817,431 filed Apr. 18, 1978 (now abandoned).

Referring further to the construction contemplated for cutter-containing feed roller 20 it is to be understood that such feed roller is mounted on chassis 10 by suitable stub shafts 24 projecting axially from the feed roller ends. A serrated cutting knife 26 is pivotally mounted within feed roller 20 in a manner to swing about an axis which is laterally displaced from the plane of the serrated cutting edge of knife 26. The periphery of feed roller 20 has an opening formed therein so that the cutting edge of knife 26 can be projected beyond the exterior of the feed roller and retracted back into the feed roller.

The operating means to project and retract the knife 26 contained within feed roller 20 is provided by a stationarily mounted cam at at least one end of feed roller 20, this cam providing a cam pocket 28 opening toward the end of feed roller 20 with which it is associated. The pocket 28 has a semi-cylindrical portion with its center of curvature corresponding with the axis of stub shaft 24 and also has an outwardly curved portion extending away from the axis of the feed roller 20. This latter portion is joined at its ends with the ends of the semi-cylindrical portion to form pocket 28 into an endless cam configuration.

The serrated cutting knife 26 is carried on a member (not shown) located within the interior space in feed roller 20 which provides a pivot axis which is displaced from the plane of cutting knife 26. The knife also has a cam follower 30 disposed in the plane of cutting knife 26 with this cam follower fitting into the pocket 28 of the stationary cam. Thus, the interengagement between cam follower 30 and cam pocket 28 acts to propel controlled extension and retraction of the cutting knife 26 out of and back into the feed roller 20 as such roller rotates dispensing sheet material from one or more source rolls.

On FIG. 1, the several positions for cutting knife 26 shown in phantom, illustrate the path which the knife follows under control of cam pocket 28 and cam follower 30 in its projection from within the feed roller 20 beyond the periphery of such feed roller. Accordingly, incident this rotation of feed roller 20, knife 26 projects outwardly, piercing the web of sheet material and severing it for removal of an individual discrete length of the material from the dispenser through elongated opening 18.

As heretofore mentioned, a fuller understanding and more detailed description of the action of stationary cam pocket 28 in controlling, through cam follower 30, the projection and retraction of knife 26 may be found in U.S. Pat. No. 4,188,844 and patent application Ser. No. 58,867.

It may be mentioned that at least selected portions of the peripheral surface of feed roller 20 may advantageously be surfaced with a high friction material. While the advantages of such high friction surfacing on the feed roller will be implicit from the concepts and objectives of the invention described herein, it may be noted that an important advantage of such high friction surfacing derives from the fact that dispensing ideally achieves its web cutting and dispensing action by the pull or draw applied to the web when the free end thereof is grasped by the intending user from outside the dispenser chassis 10. At this time it is important that frictional driving engagement between the web passing over the feed roller and the feed roller surface be sufficient to drive the cam actuated knife 26 to perform its web cutting function in dispensing cut web sections as individual sheets.

Reference may now be made to the chassis carried means for rotatably supporting multiple source rolls within the dispenser in accordance with the invention. It is to be understood that the rotatable support for the multiple source rolls as shown in FIG. 1 contemplates the state of the source rolls in which they exist during the limited period of transfer which occurs during final exhaustion of the source roll which had been in the initial dispensing position and start up of dispensing from the one source roll which has been retained in a reserve roll status pending substantial depletion of the initial roll.

Thus, the one source roll S is supported on dispenser chassis 10 to rest on feed roller 20. Simiarly, the other source roll A is rotatably supported at a location to the side of feed roller 20, not resting on such feed roller with the web of material from each of rolls S and A passing over feed roller 20. During this transitional period of exhausting material from roll A while web material from roll S is just commencing to be dispensed, the several plies of material WS and WA will be exiting through elongated opening 18 of chassis 10 in the relationship shown on FIG. 1.

The rotatable support means on chassis 10 for the one source roll S is diagrammatically illustrated on FIG. 1. The sidewalls of the dispenser chassis 10 may suitably be provided with opposed vertical tracks 40, a portion one such track being shown on FIG. 1. These opposed tracks 40 face inwardly to receive therein the spindles 42 projecting outwardly from the core of the source roll S. The spindles 42 may be provided by carrier means within the source roll core in the form of a mandrel having its ends projecting outwardly from both ends of the core of source roll S or in the form of end caps each providing a spindle with a separate end cap pressed into each of the roll core ends.

The guiding interengagement between opposed tracks 40 and spindles 42 of the one source roll S serves to allow the source roll S to rest on the feed roller 20 in the manner as shown on FIG. 1. As roll S is depleted by withdrawing web material WS from the dispenser, the roll S will ride down under the guiding cooperation between spindles 42 and opposed tracks 40 with the roll continuing to rest on feed roller 20. It will be understood that in the prior dispensing of web material WA from source roll A before it moved into its position as shown on FIG. 1, the source roll A likewise has spindles similar to spindles 42 which were guided in the opposed tracks 40 during dispensing from roll A which now, in its nearly depleted state as shown in FIG. 1, assumes the location where it is rotatably supported until all of the web material WA is exhausted from the core of roll A.

Again, it will be understood that the above rotatable support for the one source roll S as provided by opposed tracks 40 and spindles 42 can be more fully understood, if necessary, by reference to U.S. Pat. No. 4,188,844 and patent application Ser. No. 58,867 filed July 19, 1979.

The rotatable support means for the other source roll A, which as shown in FIG. 1 has reached a nearly exhausted or depleted state, is provided by a shelf 44 provided adjacent the backwall 14 of chassis 10. Shelf 44 defines a pocket located above the bottom 16 of chassis 10 into which the nearly spent other source roll A drops, such as would occur when the spindles for roll A which have been guidingly engaged in the opposed tracks 40 pass from the lower ends of such tracks incident depletion of material from roll A and consequently diminished diameter of the roll to its nearly depleted condition as shown on FIG. 1. The other source roll A is rotatably supported in the pocket provided by shelf 44 as its exterior rests on the shelf 44. Then, while the web material WA is being exhausted from the few remaining turns on nearly depleted roll A until only the core of roll A remains on shelf 44, roll A rotates against the surface of shelf 44.

As explained hereinabove, it is during the transitional period when several plies of web material such as WS and WA are being fed from multiple source rolls such as S and A that performance of effective joint severing or cutting of the two or more plies of web material can be a problem. With the cutting means such as knife 26 being pushed through the several plies of material, there is a tendency for slippage to occur between the webs such as WS and WA. In solving this problem, the concepts of the invention operate to apply a retarding force to the exterior of the one source roll S.

The point of applying the retarding force is remote from the point R where the one source roll S rests on feed roller 20. The location of this retarding force application should be between 270° and 360° circumferentially of the source roll exterior from the resting point R of the one source roll S on feed roller 20. A specific location for this retarding force application is preferably at approximately 320° relative to the support axis for source roll S from the point of rest R for such source roll on the feed roller 20.

It also is advantageous in carrying out the concepts of this invention, that applying the retarding force to the exterior of the one source roll S be discontinued or terminated after a predetermined portion of web material has been depleted from the source roll S. Since application of the retarding force is only deemed necessary during the transitional period between depletion or exhaustion of source roll A and while several plies of material are jointly passing over feed roller 20, it is not deemed necessary for this retarding force application to continue beyond the time that the web material from the other source roll A will have been exhausted. After such exhaustion, only a single web WS will be coming from source roll S and the cutter mechanism operation in conjunction with feed roller 20 can be fully effective in continuing cut-web dispensing from source roll S until this roll also is depleted.

In the embodiment illustrated on the drawings, the retarding force applying means is provided by a flexible spring band 50 mounted on dispenser chassis 10. For simplicity of illustration, the mounting of this band is shown by providing a suitable bracket 52 on the inside of front 12 of chassis 10. The flexible spring band 50 is rendered yieldable to the weight of a source roll S pressing thereagainst by one end of the band being fixed at 54 and the other end of such band being slidably restrained by passing through opening 54 in bracket 52.

The flexible spring band 50 also preferably has a length of friction sleeve 58 enclosing a segment the band where the band is to press against the exterior of the one source roll S. It has been found that the frictional contact supplemented by friction sleeve 58 offers advantages when the one source roll S first drops into its rest point R with feed roller 20 for web WS to be peeled from roll S and effectively fed through the cutter mechanism associated with feed roller 20.

It should be noted that the yieldable member provided by spring band 50 carrying friction sleeve 58 is limited in the period during which it contacts roll S, ideally to discontinue the application of retarding force after the remaining web material that was left on the other source roll A has been fully depleted.

As shown on FIG. 1, the weight of source roll S pressing down to rest at R on feed roller 20 has deflected the yieldable member formed by spring band 50 to the solid sectional configuration shown on FIG. 1. As the one source roll S has the web material withdrawn therefrom to diminish the roll diameter such as to the state shown in phantom lines on FIG. 1, the band 50 and friction sleeve 52 carried thereby will progress outwardly to the phantom line showing for the sleeve exterior as also shown on FIG. 1. It follows that when the diameter of source roll S has diminished to the point of sleeve 52 shown in phantom on FIG. 1, the application of retarding force will be discontinued. Thereafter normal single web ply dispensing from source roll S will continue, considering that the web material from the other source roll A has by then already been fully depleted.

Differing explanations as to the manner in which the application of a retarding force to the exterior of the one source roll at a point remote from its rest point on the dispenser feed roller could be put forth. However, in actual testing it has been found that the application of a relatively light force in the manner hereinabove described, and at the location hereinabove discussed, does offer benefits in jointly severing several plies of material of preventing slippage between the web plies. The concepts of the invention simply use the forces of gravity and weight of the one source roll S to eliminate this interweb slippage. Consequently, the interengagement between the web plies is enhanced to enable their being jointly cut by the cutter without undue slippage between the web plies incident dispensing from multiple source rolls.

Merely to exemplify actual force measurements in an embodiment of the invention in a dispenser, a force of 3/10th of a pound applied at approximately 320° from rest point R was found necessary to effectively cut two web plys while a force in the order of a ½ pound was found necessary if applied at a location 270° circumferentially on a one source roll S. Similarly, it was found that increased force to achieve the effective two web cutting needed to be applied in the order of 1½ pounds 180° circumferentially from rest point R and 3½ pounds 90° circumferentially from rest point R. Considering that the source roll S weighs approximately 3 pounds when whole and loaded into the dispenser it follows that the pressure required for effective two web severing at 90° and points closer to rest point R would have to be greater than the weight of the one source roll S so as to effectively prevent roll S from moving down into rest contact with feed roller 20. Also any force applying means located within 270° circumferentially from rest point R would be in the path of source roll S as it moves down in the vertical tracks 40 to make continual contact or rest on feed roller 20.

Only a single preferred embodiment of the invention is described above. However, it should be realized that the scope of the invention is not limited by such description but is only governed by the scope of the appended claims.

I claim:

1. In a dispenser for rolled flexible sheet material wherein several plies of material fed from multiple source rolls are to be jointly severed, a cut-web dispensing method comprising:

resting one source roll on a dispensing feed roller;

jointly passing web plies over said feed roller from each of said one source roll and another source roll;

continuously applying a retarding force to the exterior of said one source roll at a fixed point remote from the point where said one source roll rests on said feed roller;

jointly cutting said web plies as they pass over said feed roller; and discontinuing application of said retarding force upon depletion of a predetermined portion of web material from said one source roll.

2. The cut-web dispensing method recited in claim 1 further comprising:

applying said retarding force at a location between 270 and 360 degrees circumferentially on said one source roll exterior from the resting point of said one source roll on said feed roller.

3. A dispenser for rolled flexible sheet material comprising:

a chassis adapted to be attached to a wall at a location for flexible sheet material use;

a feed roller mounted on said chassis to rotate near the lower end thereof, said feed roller being associated with a cutter operable to cooperate with said feed roller to cut material passing over said feed roller;

means carried by said chassis for rotatably supporting multiple source rolls for the web from each roll to pass over said feed roller with one source roll supported to rest on said feed roller; and means stationarily and non-rotatably mounted on said chassis to apply a retarding force to the exterior of said one source roll at a fixed point remote from the point where said one source roll rests on said feed roller.

4. A dispenser as recited in claim 3 wherein said feed roller has said cutter contained therein, and operating means is provided to extend said cutter beyond the periphery of said feed roller to cut material as said feed roller rotates during material dispensing.

5. A dispenser as recited in claim 4 wherein said operating means includes cam means associated with said feed roller and cooperating with said cutter to project and retract the cutter relative to the feed roller periphery.

6. A dispenser as recited in claim 3 wherein said one source roll support means comprises opposed track means on said chassis adapted to guide carrier means extending axially from the source roll core for said one source roll to rest on said feed roller.

7. A dispenser as recited in claim 6 wherein said means for rotatably supporting multiple source rolls includes shelf means on said chassis to rotatably support another source roll.

8. A dispenser as recited in any one of claims 3–7 wherein said force applying means is mounted at a location between 270 and 360 degrees to the support axis of said one source roll from the point of rest for such roll on said feed roller.

9. A dispenser as recited in claim 8 wherein said force applying means is mounted at approximately 320 degrees.

10. A dispenser as recited in any one of claims 3–7 wherein said force applying means comprises a yieldable member mounted to press against the exterior of said one source roll until a predetermined portion of web material has been depleted from such roll.

11. A dispenser for rolled flexible sheet material comprising:

a chassis adapted to be attached to a wall at a location for flexible sheet material use;

a feed roller mounted on said chassis to rotate near the lower end thereof, said feed roller being associated with a cutter operable to cooperate with said feed roller to cut material passing over said feed roller;

means carried by said chassis for rotatably supporting multiple source rolls for the web from each roll to pass over said feed roller with one source roll supported to rest on said feed roller; and retarding force applying means including a yieldable member in the form of a flexible spring band mounted on said chassis to press against the exterior of said one source roll at a point remote from the point where said one source roll rests on said feed roller until a predetermined portion of web material has been depleted from said one source roll.

12. A dispenser as recited in claim 11 wherein said band has a friction sleeve enclosing a segment of said band where said band is to press against said one source roll.

13. A dispenser as recited in claim 11 wherein said band is fixed at one end and the other end slidably restrained with the segment of said band between said ends being bowed toward pressing engagement with said one source roll.

* * * * *